US006326883B1

(12) United States Patent
Whitehead et al.

(10) Patent No.: US 6,326,883 B1
(45) Date of Patent: Dec. 4, 2001

(54) DEVICE FOR MONITORING THE DELIVERY OF A SPEECH

(75) Inventors: David K. Whitehead, Wheatridge; Arthur A. Minderler, Arvada, both of CO (US)

(73) Assignee: Tym Tek, LLC, Wheatridge, CO (US)

( * ) Notice: Subject to any disclaimer, the term of this patent is extended or adjusted under 35 U.S.C. 154(b) by 0 days.

(21) Appl. No.: 09/645,658

(22) Filed: Aug. 24, 2000

(51) Int. Cl.[7] ..... G08B 1/00

(52) U.S. Cl. ..... 340/309.15; 340/309.3; 340/309.4; 368/71; 368/83; 368/84; 368/88

(58) Field of Search ..... 340/309.15, 309.3, 340/309.4, 309.5; 368/71, 82, 83, 84, 88, 107, 108

(56) References Cited

U.S. PATENT DOCUMENTS

| | | | | |
|---|---|---|---|---|
| 4,720,821 | | 1/1988 | Ke . | |
| 4,797,864 | | 1/1989 | Stano et al. . | |
| 4,995,018 | * | 2/1991 | Edwards | 368/107 |
| 5,012,435 | | 4/1991 | Bailey et al. . | |
| 5,140,564 | * | 8/1992 | Rich | 368/107 |
| 5,195,061 | * | 3/1993 | Curtis et al. | 368/9 |
| 5,325,340 | * | 6/1994 | Ramsey | 368/3 |
| 5,621,705 | | 4/1997 | Quine . | |
| 5,854,774 | | 12/1998 | Timme . | |
| 5,901,116 | | 5/1999 | Quine . | |
| 5,905,694 | | 5/1999 | Rothberg . | |
| 5,978,939 | * | 11/1999 | Mizoguchi et al. | 714/55 |
| 6,104,674 | * | 8/2000 | Emoff et al. | 368/109 |

* cited by examiner

*Primary Examiner*—Daniel J. Wu
*Assistant Examiner*—Toan Pham
(74) *Attorney, Agent, or Firm*—Roger A. Jackson

(57) ABSTRACT

A device and method for monitoring the delivery of a speech having selected time limits for specific speech types, includes a housing having a control panel, a clock display, and an array of different colored light emitting elements that are activated corresponding to specific speech time limit intervals. A timing circuit generates a signal to a control circuit that corresponds to a specific speech type, wherein the control circuit generates event marker signals that correspond to the lapse of a series of sequential selected time periods in the control circuit. The event marker signals provide for the sequential indication of the light emitting elements that allows for minimal distraction to the speaker to monitor their speech timing while allowing the speaker to wind up the speech in a smooth and timely manner.

24 Claims, 8 Drawing Sheets

DEVICE FOR MONITORING THE DELIVERY OF A SPEECH

FIELD OF INVENTION

The present invention generally relates to public speaking and more particularly to speeches that must adhere to preset time limits that correspond to specific types of speeches. The invention addresses this situation by having preset time ranges that alert the speaker, timekeeper, and audience involved of the various time limits of interest relating to a particular speech.

BACKGROUND OF THE INVENTION

It is desired at times that a given speech conform to a time limit due to multiple speakers, the type of audience, a particular program, the forum, or context that the speech is given in. Speech time limits apply across many fields of endeavor, such as law where lawyers must make oral arguments in court, or in the educational area where public speaking training emphasizes speech timing for effective communication, and in the scientific, technical, or business fields where multiple presenters must conform to time limits as part of a larger program or seminar/symposium time limit. In addition, the effectiveness of a speech's delivery and the message communicated to the audience is dependant upon the timing of the speech for maximizing the comprehension and interest by the audience. Given the importance of speech timing and the need for it at times, there have been a number of attempts to address this issue in helping a speaker keep track of his or her speech time while giving the speech. The difficulty often has been the inherent problem of the speaker's attention and effort being entirely consumed by the speech itself and the inability of the speaker to put anything other than minimal attention on keeping track of time during the speech. In addition, a speaker will risk losing his or her speech pace or train of thought if they stop to acknowledge where the speech is at, time wise for a particular moment. Doing this, and having to regain his or her speech pace and train of thought can be difficult with the attendant psychological pressure of the audience on the speaker.

The ways in which speaker's have attempted to overcome this, are to rehearse their speeches extensively to practice timing or frequently glancing at a clock, wristwatch, or stopwatch while giving the speech. These methods can be of some assistance, however, they are of limited value, as rehearsing a speech for timing rarely translates to the same timing in front of an audience as questions can be asked or the speaker's pace of speaking inadvertently changes in front of the audience. Thus, rehearsing the speech under different circumstances than when the actual speech is given is not usually a reliable way to control or predict the timing of a speech. Also, glancing at a timing device can interrupt a speaker's pacing or train of thought as a quick mental calculation needs to be made comparing the timing device indication to the actual time left for giving the speech or approximately what portion of the speech should be completed given the time observed. This interruption of the speaker's attention can knock the speech off of its pace and possibly cause the speaker to take additional time to refocus on where to resume his or her speech, all of which lessen the effectiveness of the presentation.

As the timing of a speech usually has some level of importance, there remains a need for a device that is easy to use, detracts minimal attention from the speaker, is portable, is versatile for many differing speaking situations, and can record elapsed time.

SUMMARY OF THE INVENTION

It is an object of the present invention to provide a new and useful speech-monitoring device and method to assist a speaker in maintaining proper timing while monitoring the duration of his or her speech with minimal distraction to maximize the opportunity for a well-paced and timely speech.

It is another object of the present invention is to provide a speech monitoring device that is simple to use, thus minimizing the distractive effort of the person who is monitoring the speech whether that person is the speaker or another individual who is monitoring the speech.

It is a further object of the present invention to provide a speech-monitoring device that has consistency in monitoring specific speech types.

Still another object of the present invention is to provide a speech monitoring device that is aesthetically pleasing, while being relatively inexpensive to produce.

Yet another object of the present invention is to provide a speech monitoring device with a perceptible output that consists of a series of indications to the speaker so as not to interrupt the flow and pacing of the speech by giving adequate time for the speaker to wind up the speech on time in a seamless manner with minimal attention required from the speaker.

Still yet another object of the present invention is to provide a speech-monitoring device that is portable and versatile to be easily operated in different types of settings.

According to the present invention, then, a speech monitoring device and method is provided to assist a speaker in maintaining proper timing for his or her speech with minimal distraction to maximize the opportunity for a well-paced and timely speech. Broadly, the present invention includes timing circuitry that is operative upon activation to generate a timing signal, control circuitry operative in each of a plurality of modes to monitor the timing signal and to produce one of a plurality of event marker signals, each after a corresponding one of a plurality of selected time intervals. Also included, is a means for producing an associated perceptible output in response to each of the event marker signals. In addition, mode selection circuitry is provided for a single selection of one mode corresponding to a type of speech from a plurality of modes, with the mode selection circuitry being in electrical communication with the control circuitry and the mode selection circuitry operative in each of a plurality of states to place the control circuitry in a respective one of the plurality of modes. The timing circuit, control circuit, perceptible output, and mode selection circuitry are all disposed within a housing.

In the preferred embodiment of the present invention, the housing is portable having the ability to be used in multiple locations and has a control panel that contains all the necessary functions for operating the speech monitoring device. It is desirable that a light emitting digital clock display that receives the timing signal be included in the control panel of the housing for the purpose of recording the actual elapsed time of the speech even if the speech is over a specific speech type time limit. Another desirable feature of the preferred embodiment of the speech-monitoring device is to have a series of three different colored sequentially activated LED's that alternate between on and flashing. The sequence is to have a green LED on, then a yellow LED on and the green LED off, then a red LED flashing and the yellow LED off, and finally the red LED on, being non-flashing. The multiple LED actuations are based on a sequential series of event marker signals from the control circuit, which correspond to a specific speech type.

Based upon the type of speech being given, a mode is selected from the control circuitry corresponding to the specific speech type. There are additional modes available for other speech types in the control circuitry. A control is then initiated that is operative to activate the timing circuitry. The control circuit is then operative in a selected first one of the modes to generate a respective first mode first event marker signal after a respective first mode first selected time interval to actuate the green LED. Continuing in a like manner, the control circuit for the selected first mode generates a respective first mode second event marker signal after a respective first mode second selected time interval to activate the yellow LED and deactivate the green LED. Next, a respective first mode third event marker signal is generated after a respective first mode third selected time interval to activate the red LED in a flashing state and deactivate the yellow LED. Finally, a respective first mode fourth event marker signal is generated after a respective first mode fourth selected time interval to activate the red LED into a steady on state.

It is anticipated that the speech monitoring device be used with a control circuit corresponding to four specific speech type modes with a particular speech type being selected by the use of a mode control button. The selection of a specific speech type mode allows for the correct time periods for a particular speech to be consistently applied without any additional effort or attention on the part of the user of the speech-monitoring device, outside of the speaker being aware of the LED indications for monitoring the speech time limits. After selection of the speech type mode, a start/stop button is activated to initiate the timing signal from the timing circuit when the speaker commences speaking. At the end of the speech the start/stop button is activated again, that suspends the timing signal and freezes the digital clock display for recording the total speech elapsed time. A reset button is then activated to clear the timing circuit and the digital clock display to prepare the speech monitoring device for the next speech selected by the mode control button.

The speech-monitoring device can be used by the speaker on the podium, or by an individual whose duty is to monitor speeches that are given by others, or by an individual who is rehearsing his or her speech without an audience. Here, the portability of the speech-monitoring device is useful with the capability of using A.C. or battery power.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENT

The present invention relates to devices that monitor speeches of specific types for the purposes of organized and expedient speaking presentations in a group setting, for training to assist speakers in developing effective oral communications in refining their speech timing, or in formal oral presentation settings where speaking time limits must be strictly adhered to. Given that the monitoring of a speech is generally desired, a desirable and beneficial result would be a device that is easy to use and not obtrusive to the speaker, is portable, and has the complete flexibility to be used in many different speaking situations. While the preferred use of the speech-monitoring device is for public speaking training, many other uses are contemplated related to the monitoring of a speech. For instance, oral arguments in legal proceedings, the giving of technical and business presentations in seminars, symposiums, and various business meetings, individual speaker use for speech monitoring practice, entertainment, churches, and schools. Any number of specific speech types for a particular application or situation can be accommodated by the speech-monitoring device. This is what allows for easy use of the speech-monitoring device as the user selects the applicable speech type and starts the timing signal when the speaker starts the speech and the device then provides the correct perceptible outputs or indications to the speaker for the various timing points of interest for that particular speech. The particular housing shape and configuration of the device could take on a number of configurations other than the parallelopiped shape. As an example, the relationship between the length, width, and height of the housing may be in any combination that either advances in circuitry and power supply allow or is required by a particular use of the speech-monitoring device. In addition the control panel configuration may assume different orientations as a particular use may dictate.

Figure 1:
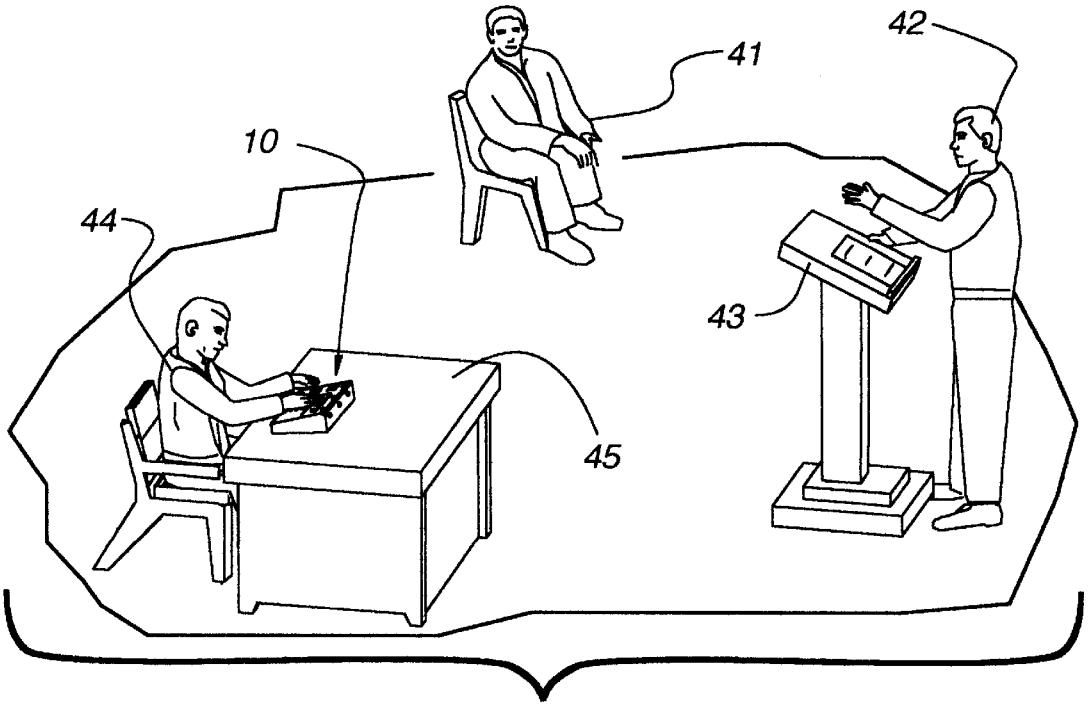
FIG. 1 is a perspective view of the speech-monitoring device in use with a speaker at the podium, a seated observer, and the timekeeper at a desk using the device.

With initial reference to FIG. 1, the preferred use of the device 10 is with a timekeeper 44 operating the device at the timekeeper's table 45, with a speaker 42 at the podium 43, and one or more observers 41. The exemplary embodiment of the invention is accordingly shown in FIGS. 2 through 6. The timekeeper 44 in using the device 10 would activate the power switch 36 and then select a mode that corresponds to a specific type of speech being given by the speaker 42 as shown by the indicia 40 on the housing control panel 13. The speech mode selection is accomplished by activating the mode selection button 32, the required number of times until the desired LED indication 15, 17, 19, 21, or 23 is activated corresponding to the type of speech to be given. At this point the timekeeper 44 would depress the start/stop button 34 to start the device 10 when the speaker 42 commences his or her speech. During the speech, the speaker 42, the observer 41, and the timekeeper 44 can all acknowledge the means for perceptible output of the device 10 by the following indicators. The preferred indicators are six LED's mounted in the housing 12. There are two each of LEDs 14, 16, and 18, having colored indications of green, yellow, and red respectively for the purpose of speech timing feedback to all individuals present during the use of the device 10. The particular sequence of the perceptible outputs is as follows: firstly, the green LEDs 14 go on, secondly, the yellow LEDs 16 go on with the green LEDs 14 going off, thirdly, the red LEDs 18 start flashing and the yellow LEDs 16 go off, and finally the red LEDs 18 go from flashing to on. Alternative indicators can be an auditory device to give a warning to a speaker who may be blind or in an instance where the speaker may not be in visual contact with the device 10. Also, an auditory output may be a singular indicator, or a series of indicators that are monotone, pulsate, change frequency, volume, or tone. In addition, another indicator may be a form of visual display, which could be a series of colored indicators that may or may not be illuminated. Also, the visual display may be a singular indicator, a series of indicators that are steady on, pulsate, change frequency in pulsations, are multiple colors, and could change in visual intensity.

To make the device 10 useable in a number of different locations, an internal battery may power it. However, to reduce the internal battery use an external D.C. adapter port 38 is provided to accommodate an external D.C. power source for use of the device.

The speech timing device assembly 10 is shown with the housing 12 substantially as parallelopiped in shape with one surface configured as an inclined control panel 13. The indicia 48 and 40 on the inclined control panel 13 are for the mode selection button 32 and the selected specific speech type mode respectively. A numeric display 20 to indicate elapsed speech time by measuring duration of the timing signal is shown mounted in the control panel 13. Using the numeric display 20 is important for several reasons. First, the amount of total speech time is known, allowing the speaker 42 to know what his or her speech time is, related to the three shown LED indications 14, 16, and 18, for the purpose of refining their speech delivery time. Second, the numeric display 20 allows for general speech timing or monitoring when required, in the situation where a speech is given that is not one of the specific speech types selected by mode, provided for in the device 10. The numeric display 20 can take on many forms such as an analog clock, a numerical clock, an electronic digital type clock, or any other form of a visual display to indicate time.

A reset button 22 in combination with the start/stop button 34 operates as a selective control that is operative to initialize and activate the timing circuit. A mode select button 32 is operative to select one mode at a time resulting in the selected mode having an LED indication as follows for specific types of speeches: 15 for "Prepared Speeches", 17 for "Evaluations", 19 for "Table Topics", 21 for "Ice Breaker" and 23 for "Running Time". The green LED 14, the yellow LED 16, and the red LED 18, are shown as seen from the front 31 of the device 10, thus giving the speaker 42 an associated perceptible output for the corresponding time intervals applicable to the speech that is being given.

Figure 5:
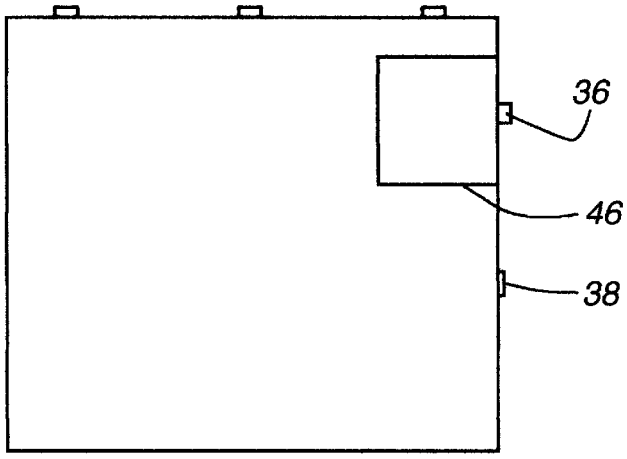
FIG. 5 is a bottom plan view of the speech-monitoring device.
Figure 6:
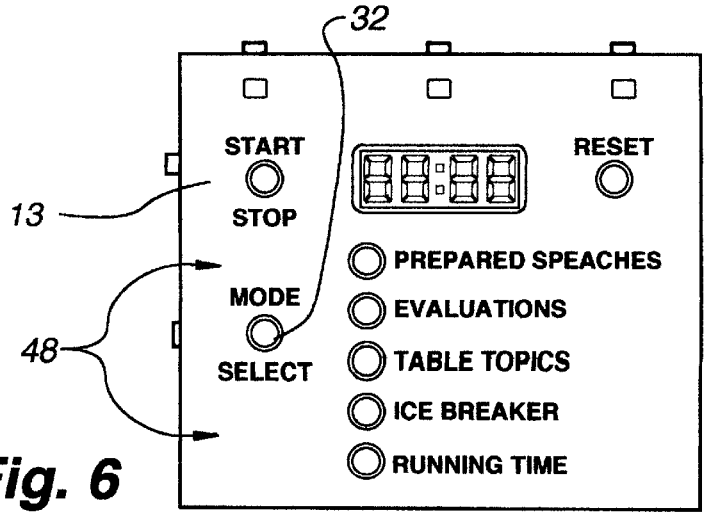
FIG. 6 is a top plan view of the speech-monitoring device.

The bottom plan view of FIG. 5 shows a battery access cover 46 that allows replacement of the battery. Also shown are the power switch 36 and the A.C. adapter port 38. The bottom of the housing 12 may have a non-skid surface or non-skid pads if desired to prevent movement of the housing on a desktop surface while the device 10 is in use.

Figure 7:
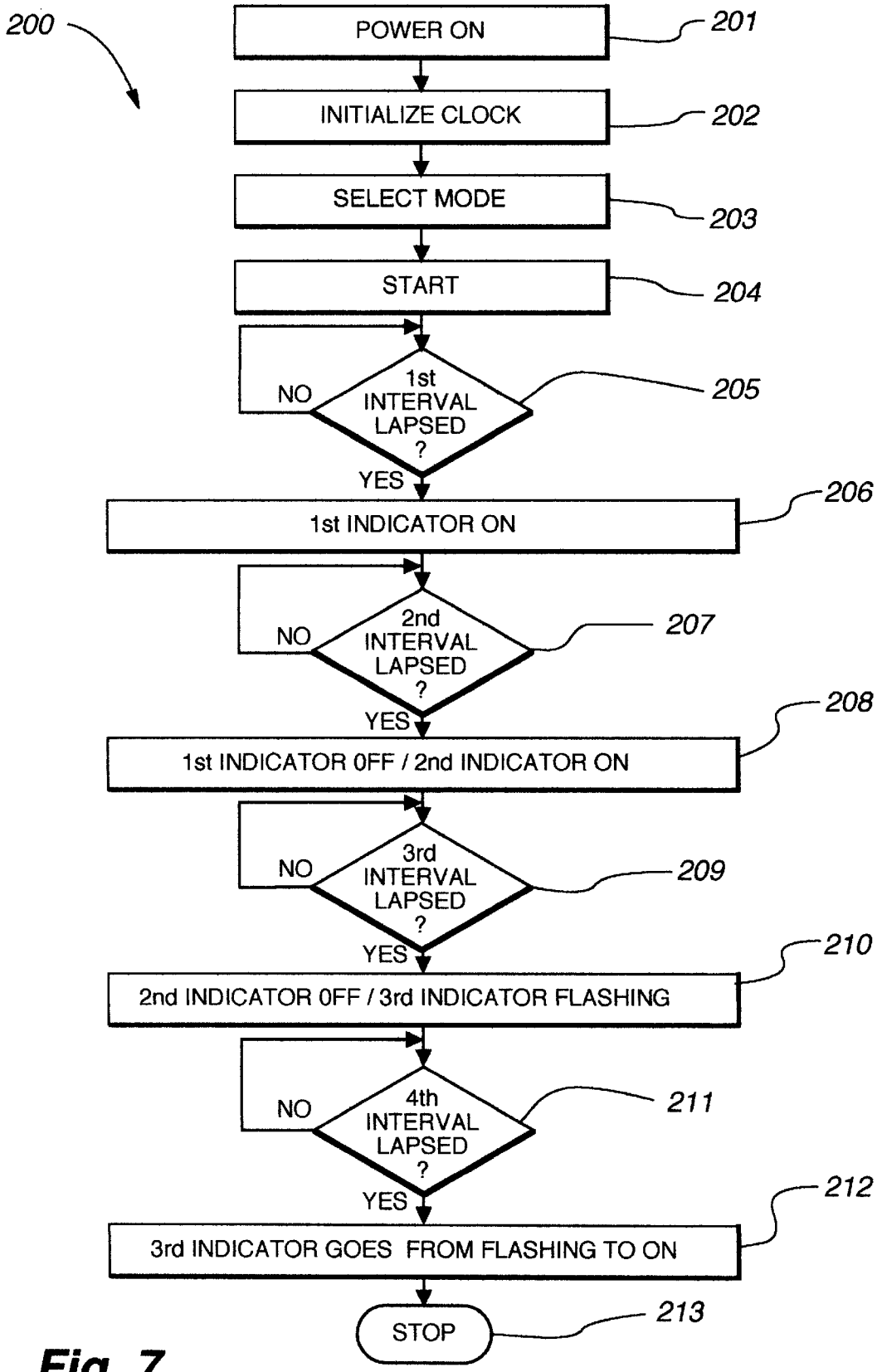
FIG. 7 is a flow chart illustrating diagrammatically the broad concepts according to the methodology of the present invention.

FIG. 7 summarily diagrams a flowchart depicting the overall operation of the speech-timing device. To start, the first step 201 is to activate the power and the next step 202 is to initialize the clock or set to zero; note that if a previous speech was given and the power was not turned off, the clock would have to be re-initialized at step 202. The next step 203 is to select the specific speech type mode and then to start the speech-monitoring device at step 204 being coincident with the speaker initiating his or her speech. When a specific speech type mode is selected a correspondingly unique set of time intervals for that speech is used resulting in four sequential different time intervals. After the speaker starts his or her speech and a selected amount of time passes, a first lapsed time interval occurs, resulting in step 205 that leads to the next step 206 of activating the first indicator, by use of a first event marker signal. In a like manner, as the speech continues, a second lapsed time interval occurs resulting in step 207 then leads to step 208 which activates a second indicator, and simultaneously deactivates the first indicator, by use of a second event marker signal. As the speech continues to progress, a third lapsed time interval occurs resulting in step 209 that leads to a following step 210 of activating the third indicator in a flashing state and simultaneously deactivating the second indicator, by use of a third event marker signal. When the speech nears its completion, the forth lapsed time interval occurs in step 211 that results in step 212 that changes the third indicator state from flashing to constantly on (non-flashing), by use of a forth event marker signal. When the speech is completed, step 213 occurs being the command to "Stop" the speech-monitoring device. Note that the stop step 213 can occur at any time after the start step 204, coinciding with the point in time that the speaker completes his or her speech. Although four sequential lapsed time intervals are shown, two time intervals in sequence or any number of additional sequential lapsed time intervals could be used, each activating a respective indicator sequence.

Figure 8:
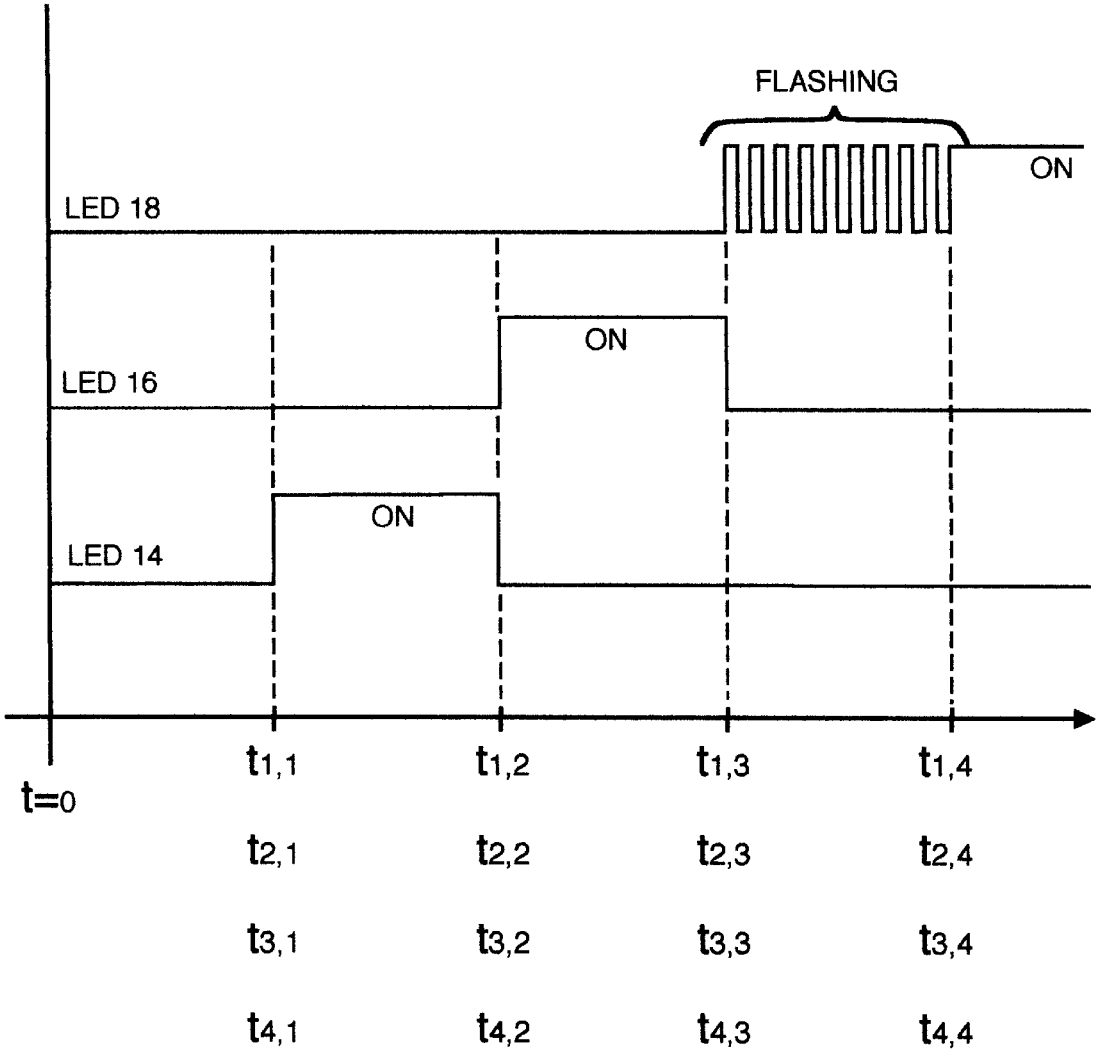
FIG. 8 is a chart showing activation of the LEDs versus elapsed time for each mode.

Moving to FIG. 8 timing detail is given with respect to the specific mode lapsed time interval points. Starting with mode one for "Prepared Speeches", LED 14 is activated, by a first event marker signal after a corresponding first selected time interval which is at 300 seconds corresponding to $t_{1,1}$, with the first "t" subscript denoting the mode number and the second "t" subscript denoting the lapsed time interval number. Next LED 16 is activated and LED 14 is deactivated, by a second event marker signal after a corresponding second selected time interval at 360 seconds corresponding to $t_{1,2}$. Next LED 18 is activated into a flashing state and LED 16 is deactivated, by a third event marker signal after a corresponding third selected time interval at 420 seconds corresponding to $t_{1,3}$. Finally, LED 18 goes from a flashing state to constantly on, by a forth event marker signal after a corresponding forth-selected time interval at 450 seconds corresponding to $t_{1,4}$.

Continuing on to the remaining three modes an identical sequence of LED activations and respective event marker signals, using four selected time intervals occurs like the first selected mode of "Prepared Speeches" with the exception of the time intervals being different as depicted below.

| Selected Mode | Time Interval | FIG. 8 Identifier | Time (Seconds) |
|---|---|---|---|
| 2nd "Evaluations" | 1 | $t_{2,1}$ | 120 |
| 2nd "Evaluations" | 2 | $t_{2,2}$ | 150 |
| 2nd "Evaluations" | 3 | $t_{2,3}$ | 180 |
| 2nd "Evaluations" | 4 | $t_{2,4}$ | 210 |

-continued

| Selected Mode | Time Interval | FIG. 8 Identifier | Time (Seconds) |
|---|---|---|---|
| 3rd "Table Topics" | 1 | $t_{3,1}$ | 60 |
| 3rd "Table Topics" | 2 | $t_{3,2}$ | 90 |
| 3rd "Table Topics" | 3 | $t_{3,3}$ | 120 |
| 3rd "Table Topics" | 4 | $t_{3,4}$ | 150 |
| 4th "Ice Breaker" | 1 | $t_{4,1}$ | 240 |
| 4th "Ice Breaker" | 2 | $t_{4,2}$ | 300 |
| 4th "Ice Breaker" | 3 | $t_{4,3}$ | 360 |
| 4th "Ice Breaker" | 4 | $t_{4,4}$ | 390 |

Figure 2:
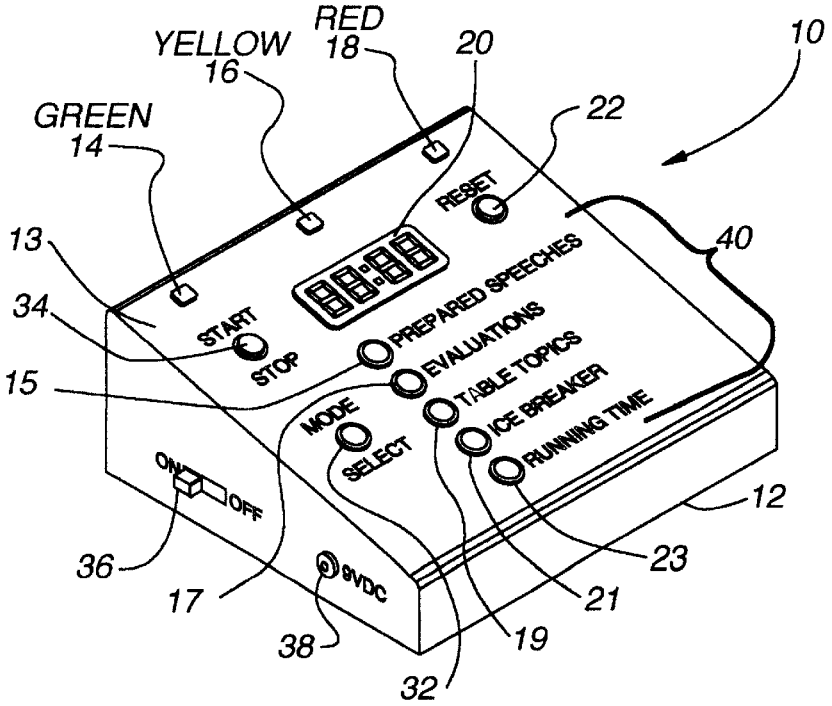
FIG. 2 is a perspective view of the exemplary embodiment of the speech-monitoring device.
Figure 3:
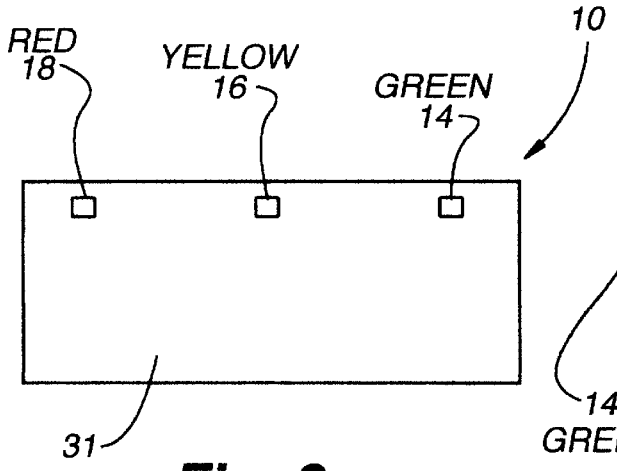
FIG. 3 is a front view of the speech-monitoring device as viewed by the speaker in FIG. 1.
Figure 4:
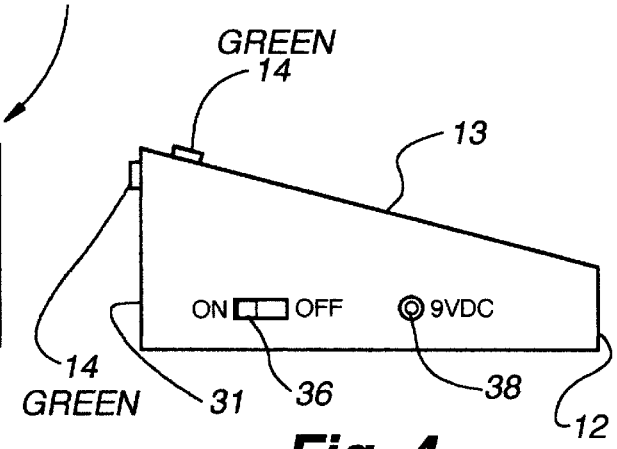
FIG. 4 is a left side plan view of the speech-monitoring device shown in FIG. 2.

A fifth mode, that is shown in FIG. 2, called "Running Time" can be selected that is solely a timer and does not have any time intervals or LED activations.

Figure 9:
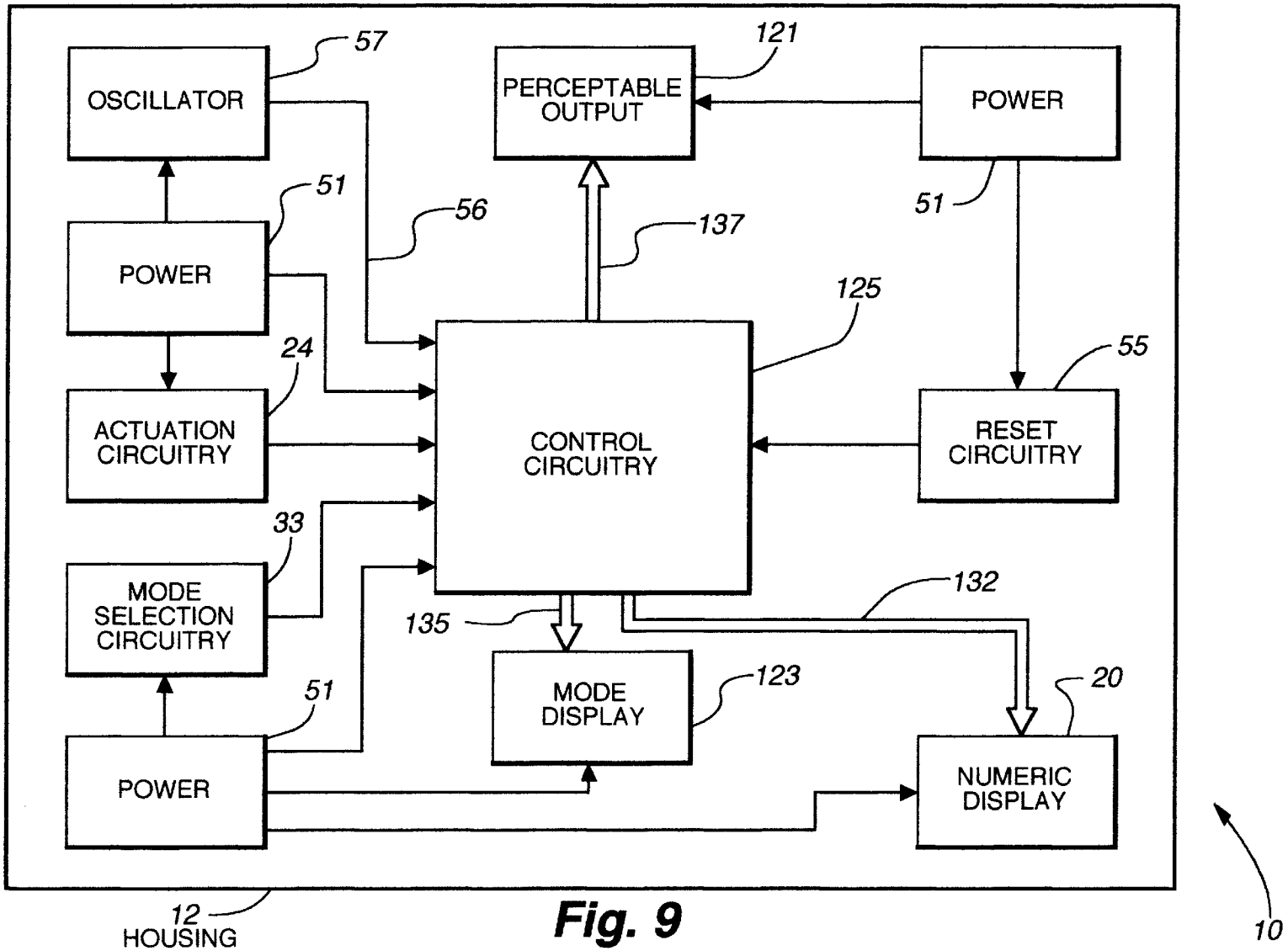
FIG. 9 is a diagrammatic view generally depicting the principal circuitry functions of the present invention.

Turning to FIG. 9, the principal features and interrelationships of the general circuitry components according to the preferred exemplary embodiment are shown. Accordingly, the housing 12 contains the various electrical components of the speech-monitoring device 10 as shown. Starting with the D.C. power supply 51, power is supplied to the following: control circuitry 125, oscillator 57, actuation circuitry 24, mode selection circuitry 33, mode display circuitry 123, numeric display 20, reset circuitry 55, and perceptible output circuitry 121. After activation of the power supply 51, which corresponds to a user sliding toggle switch 36 shown in FIG. 2, the oscillator 57, generates a 32.768 KHz timing signal 56 to the clock of the control circuitry 125. A desired mode is selected from a plurality of modes using the mode selection circuitry 33, which corresponds to a user-depressing button 32 as shown in FIG. 2. Button 32 is depressed a number of times until the desired mode is selected. Once a mode is selected, the control circuitry 125 communicates appropriate signals to the mode display 123 via data lines 135, which results in illumination of appropriate LEDs. Upon activation of the actuation circuitry 24, the control circuitry 125 communicates a series of signals to the numeric display 20 via data lines 132 to indicate the elapsed time from the start of the speech. Simultaneously, as the speech time elapses, the control circuitry 125 generates a series of event marker signals that communicate to the perceptible output circuitry 121 via data lines 137. The perceptible output circuitry 121 generates LED outputs to indicate to the speaker the progress that he or she is making toward completing the speech. After the speaker has completed his or her speech, the start/stop button 34 is depressed as shown in FIG. 2, of the actuation circuitry 24. At this point, the numeric display 20 is suspended to continuously display the elapsed time indication corresponding to the elapsed time from the start of the speech to the end of the speech. Also at this time the event marker signals are terminated, and the associated perceptible output circuitry 121 is deactivated.

In preparation for a subsequent speaker and after the start/stop button 34 in FIG. 2 is depressed, the reset circuitry 55 is activated by depressing button 22 shown in FIG. 2. The purpose of the reset circuitry 55 is to clear the display 20. This readies the control circuitry 125 for a new speech.

Figure 10:
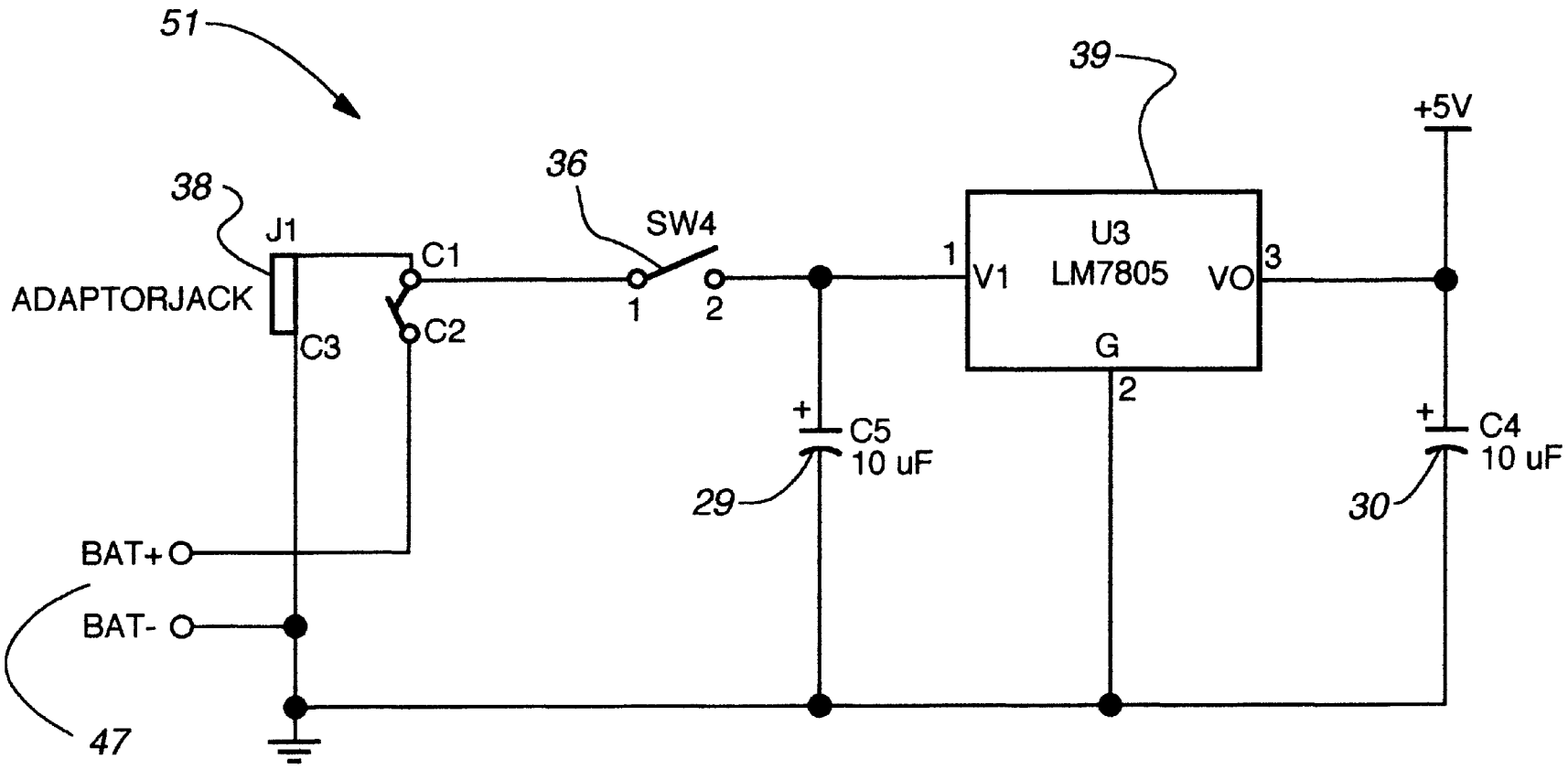
FIG. 10 is an electrical schematic of the power supply for the speech-monitoring device.

FIG. 10 shows the circuit schematic for the power supply 51 of speech monitoring device 10. While the control circuitry 125 in FIG. 9 is operative in a range of D.C. voltages, power supply 51 is designed to present five (5) volts D.C. to the circuit. A regulator is provided to convert input voltage to this D.C. level. More particularly, power supply 51 includes a voltage regulator 39 which is connectable at its input to either an internal battery through terminals 47 or an external power source through adapter jack 38. Where an internal battery is employed, it is preferably a nine-volt battery that is contained within housing 12 as discussed above with reference to FIG. 5. Where an external power source is used, the ordinary skilled artisan would appreciate that adapter jack 38 can be connected to either a self-contained external D.C. power source or an appropriate A.C. adapter that is operative to convert A.C. line voltage to an appropriate D.C. level. In any event, regulator 39 may be an LM7805CT available from the National Semiconductor Corporation, or equivalent. A capacitor 29 is connected between input pin 1 of regulator 39 and the ground, while another capacitor 30 is connected between output pin 3 and ground, as shown. Activation of regulator 39 is provided by a toggle switch 36, shown in FIG. 2, which is also connected to the input of the regulator 39.

Figure 11:
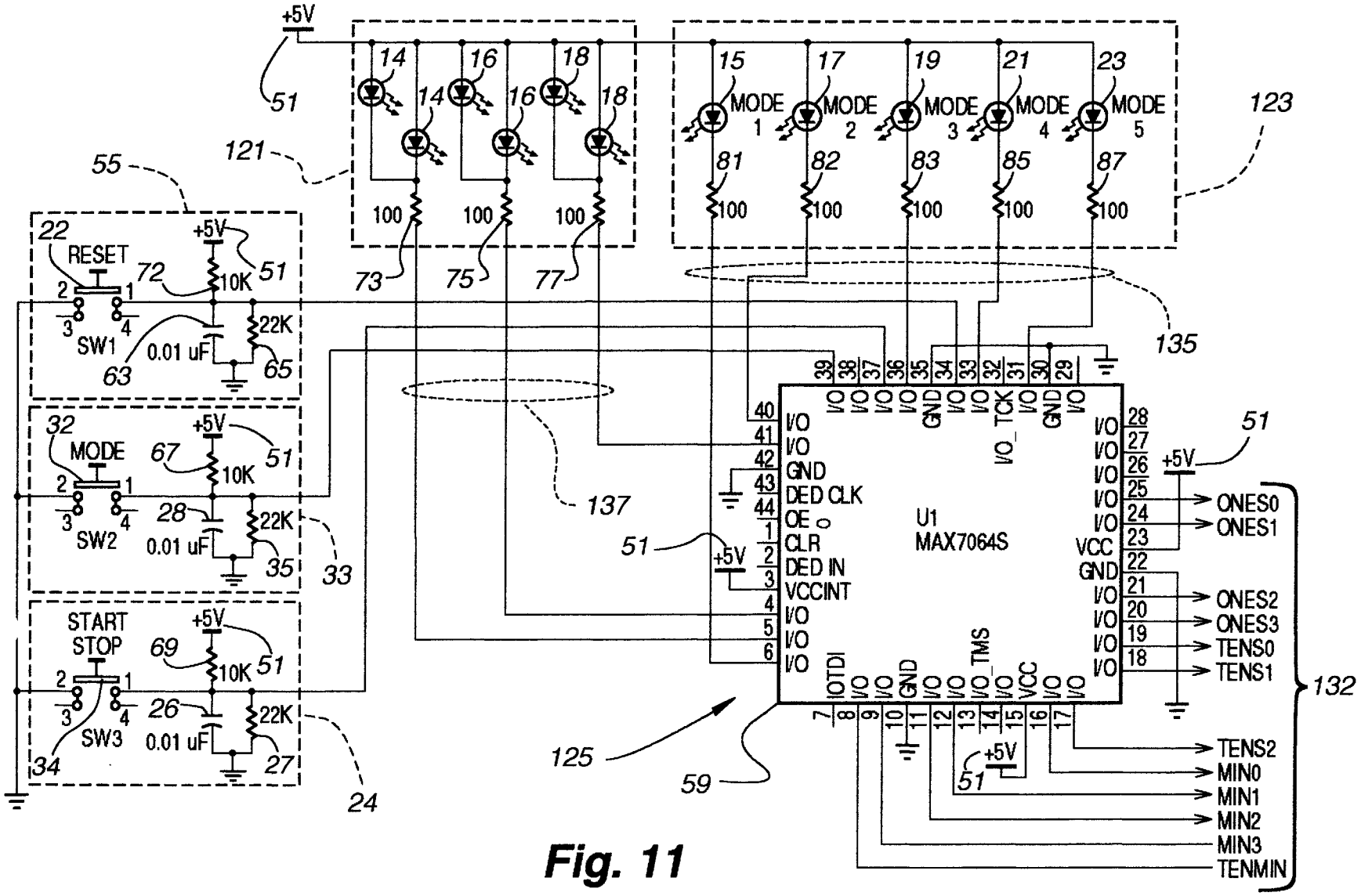
FIGS. 11 and 12 depict an electrical schematic for the speech-monitoring device.
Figure 12:
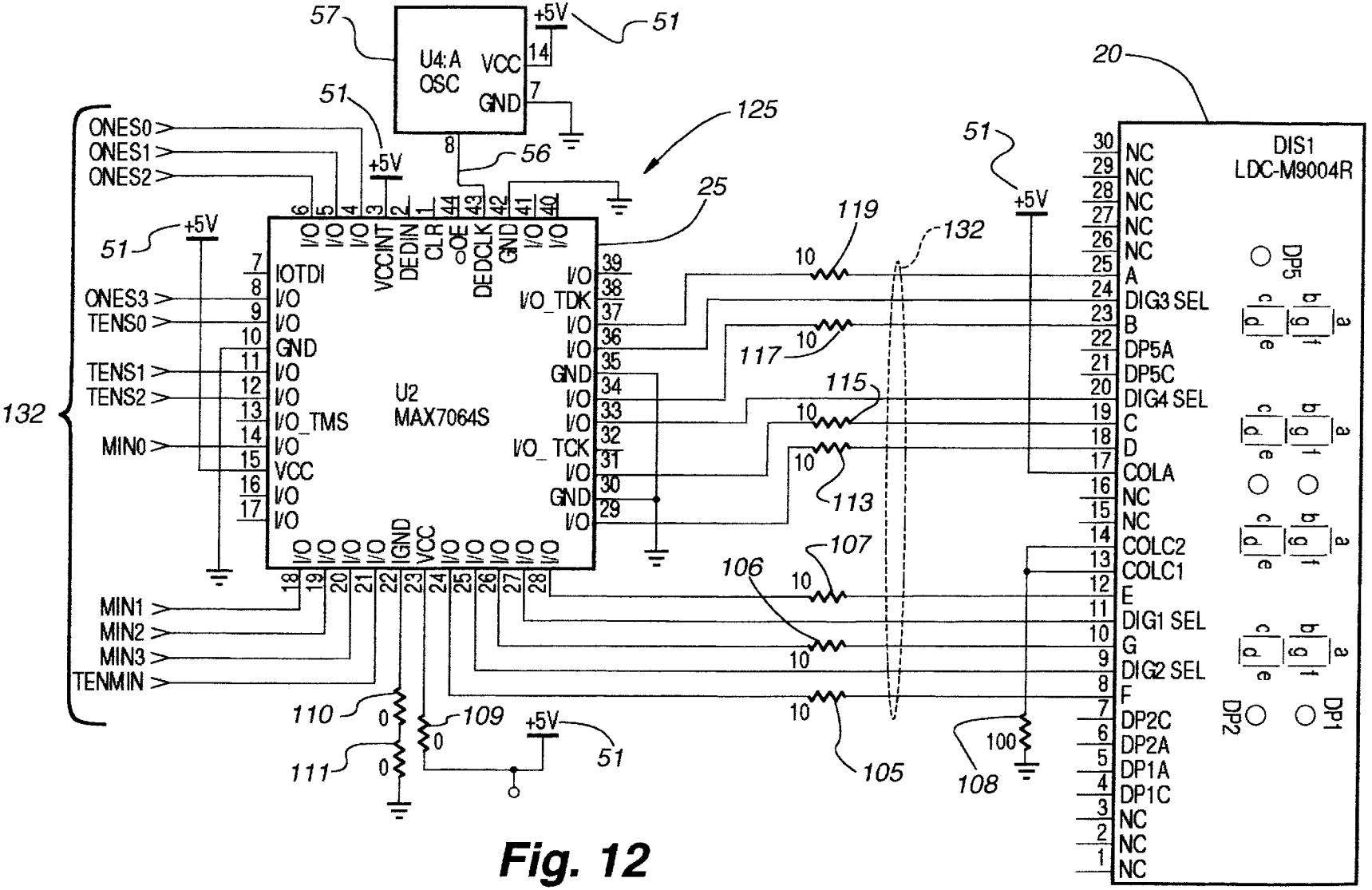

With reference to FIGS. 11 and 12, the remaining circuit schematic diagram for speech monitoring device 10 is shown according to the preferred exemplary embodiment. Accordingly, the power supply 51 from FIG. 10 provides the required five (5) volt D.C. electrical power to the remaining circuit components as shown. Beginning with the oscillator 57 in FIG. 12, which is available from Filtronics Corporation, part number F852HT5100N32.768Khz or using a suitable equivalent, five (5) volts of D.C. power is directly received at pin 14 with a direct electrical ground at pin 7. More particularly, the timing circuitry consists of the actuation circuitry 24 and the oscillator 57. The oscillator 57 generates a 32.768 KHz timing signal 56 that is received at pin 44, being the clock input of programmable integrated circuit chip 25. The timing circuitry is operative upon activation of the actuation circuitry 24, which then utilizes the oscillator 57 timing signal at the clock input of chip 25 for the control circuitry 125.

Moving to the mode selection circuitry 33 in FIG. 11, a mode is selected by depressing button 32 the required number of times until the desired mode is selected. The mode selection circuitry 33 consists of button 32 that is directly connected to electrical ground at pin 2, with pin 1 of button 32 connected to pin 39 of programmable integrated circuit chip 59. Circuitry 33 also includes a voltage divider circuit utilizing a resister 67 that is connected between the five (5) volt D.C. power supply and pin 1 of button 32 that operates with resister 35 and capacitor 28 that are in parallel together being connected between pin 1 of button 32 and electrical ground. The function of the mode selection circuitry 33 is to set a relatively high or low voltage to be present at pin 39 of chip 59 depending upon whether or not button 32 is depressed. Once a desired mode is selected, the particular mode is shown on the mode display circuitry 123, by use of mode display signals that are transmitted via data lines 135. The mode display circuitry 123 utilizes five different LED's wherein one LED will go on at a time to indicate that a particular mode is selected. Mode 1 is indicated by LED 15 that receives power of five (5) volts D.C. on the anode with the cathode connected to pin 6 on chip 59 through resister 81. In a like manner, the remaining four modes are indicated by the following connections:

| Mode | LED | Resister | Chip 59 pin No. |
|---|---|---|---|
| 2 | 17 | 82 | 40 |
| 3 | 19 | 83 | 36 |
| 4 | 21 | 85 | 33 |
| 5 | 23 | 87 | 31 |

Chips 25 and 59 together constitute the control circuitry 125. Chips 25 and 59 are programmable so that they accommodate the timing sequence of events with particular reference to FIGS. 7 and 8. Chips 25 and 59 use an appropriate programming language such as Verilog Hardware Description Language (VHDL) or an equivalent to accomplish the required sequence of events.

More particularly, chips 25 and 59 both may be an EPM7064SLC44-10 available from the Altera Corporation or equivalent. Chip 59 is directly connected to the D.C. power supply 51 of five (5) volts to pins 3, 15, and 23. Chip 59 is also directly electrically grounded at pins 10, 22, 30, 35, and 42. Chip 25 is directly connected to the D.C. power supply of five (5) volts 51 to pins 3 and 15. In addition, Chip 25 is connected to the D.C. power supply of five (5) volts 51 through resistor 109 to pin 23. Chip 25 is directly grounded at pins 10, 30, 35, and 42. Also chip 25 is electrically grounded at pin 22 through resistors 110 and 111 that are connected in series.

Moving to the actuation circuitry 24, where activation thereof corresponds to a user depressing a start/stop button 34, wherein actuation circuitry 24 activation corresponds to the point in time at which the speaker commences his or her speech. The electrical component arrangement of the actuation circuitry 24 is like the mode selection circuitry 33 previously described in that a voltage divider is used to cause a high or low voltage to be present on chip 59 by depressing the button. More particularly, actuation circuitry 24 contains button 34 whose pin 2 is connected to electrical ground and pin 1 of button 34 is connected to pin 37 of chip 59. Resister 69 is between the five (5) volt D.C. power 51 and pin 1 of button 34, and resister 27 and capacitor 26 are in parallel between pin 1 of button 34 and electrical ground. Once the actuation circuitry 24 is activated, chip 25 generates a series of signals via data lines 132 to the numeric display 20 to indicate the elapsed time from the start of the speech. The signals to the numeric display 20 are further defined as signal functions in the following chart and consist of, to "Ones" which is the ones digit for seconds in the numeric display 20, with the numeric suffix of "0–3" indicating that four separate signals apply to the ones digit for seconds in the numeric display 20. Continuing in a like manner for the signal function, "Tens" is the tens digit for seconds in the numeric display 20, with the numeric suffix of "0–2" indicating that three separate signals apply to the tens digit for seconds in the numeric display 20. Further defining the signal function, "Min" is the ones digit for minutes in the numeric display 20, with the numeric suffix of "0–3" indicating that four separate signals apply to the ones digit for minutes in the numeric display 20. Finally, signal function "Ten Min" is the tens digit for minutes in the numeric display 20, without a numeric suffix indicating a singular signal is used for the tens digit in the numeric display 20. Chip 59 and chip 25 are connected together in the following respective manner for the signals to the numeric display 20. The signals are transmitted via the following data line 132 connections:

| Signal Function | Chip 59 pin No. | Chip 25 pin No. |
|---|---|---|
| Ones 0 | 25 | 4 |
| Ones 1 | 24 | 5 |
| Ones 2 | 21 | 6 |
| Ones 3 | 20 | 8 |
| Tens 0 | 19 | 9 |
| Tens 1 | 18 | 11 |
| Tens 2 | 17 | 12 |
| Min 0 | 16 | 14 |
| Min 1 | 12 | 18 |
| Min 2 | 11 | 19 |

-continued

| Signal Function | Chip 59 pin No. | Chip 25 pin No. |
|---|---|---|
| Min 3 | 9 | 20 |
| Ten Min | 8 | 21 |

The numeric display 20, which is available from Lumex Corporation, Part number LDC-M9004R or an equivalent, is used to indicate elapsed time in a minutes and seconds format. Display 20 receives a five-volt power supply at pin 17 and is connected to electrical ground at pins 13 and 14 through resistor 108. The signals to the numeric display 20 are transmitted via data lines 132. More particularly, the signals consist of four, digit select signals that direct the individual light segment signals: A, B, C, D, E, F, and G to the selected numeric display 20 digit. The four numeric display 20 digits consist of: ones in seconds, tens in seconds, ones in minutes, and tens in minutes. More particularly, the signals to the numeric display 20 are via data lines 132 that consist of the following connections from chip 25 through the identified resistor to the numeric display 20:

| Chip 25 pin No. | Resistor | Numeric display 20 pin No. (Individual light segment) | |
|---|---|---|---|
| 24 | 105 | 8 | (F) |
| 26 | 106 | 10 | (G) |
| 28 | 107 | 12 | (E) |
| 29 | 113 | 18 | (D) |
| 31 | 115 | 19 | (C) |
| 34 | 117 | 23 | (B) |
| 37 | 119 | 25 | (A) |

In addition, data lines 132 also consist of four digit select connections between chip 25 and the numeric display 20 as follows:

| Digit select | Chip 25 pin No. | Numeric display 20 pin No. |
|---|---|---|
| 1 | 27 | 11 |
| 2 | 25 | 9 |
| 3 | 36 | 24 |

As the speaker continues to give his or her speech, thereby completing the selected time intervals as described in FIG. 8, a series of event marker signals are generated by the control circuitry 125, and specifically chip 59 thereof, to the perceptible output circuitry 121 via data lines 137. These event marker signals illuminate of a series of perceptible outputs to indicate to the speaker the progress he or she is making toward the completion of the speech. The preferred means for producing an associated perceptible output to the speaker consist of the following LED's contained in the perceptible output circuitry 121. The perceptible output circuitry 121 incorporates six LED's grouped in three sets of two LED's each. Each set of two LED's is connected in parallel and each one of the two LED sets is one of the colors green, yellow, and red respectively. Each LED receives five (5) volts of D.C. power 51 on the anode and the cathode is connected to chip 59 through a resistor as follows:

| LED color | LED | Resistor | Chip 59 pin No. |
|---|---|---|---|
| Green | 14 | 73 | 5 |
| Yellow | 16 | 75 | 4 |
| Red | 18 | 77 | 41 |

After the speaker has completed his or her speech, the start/stop button 34 is depressed. At this point the numeric display 20 is suspended to continuously display the elapsed time indication corresponding to the elapsed time from the start of the speech to the end of the speech. Also, at this time the event marker signals are terminated, and the associated perceptible output circuitry 121 is deactivated.

In preparation for a subsequent speaker and after the start/stop button 34 is depressed, the reset circuitry 55 is activated by depressing the reset button 22 thereby to clear the numeric display 20. This readies the control circuitry 125 for a new speech. More particularly, the reset circuitry 55 arrangement for the voltage divider circuitry is similar to the arrangement for the voltage divider circuitries of the mode selection circuitry 33 and the actuation circuitry 24 previously described. The voltage divider is used to cause a relative high or low voltage to be present on chip 59 by depressing the reset button 22. Specifically, reset circuitry 55 uses button 22 with pin 2 connected to electrical ground and pin 1 of button 22 is connected to pin 34 of chip 59. Resister 72 is between the five (5) volt D.C. power 51 and pin 1 of button 22, and resister 65 and capacitor 63 are in parallel between pin 1 of button 22 and electrical ground.

With the above-described circuitry in mind, a component chart including selected values is set forth in the following table I.

TABLE I

Resistors

| Element | Value (in Ohms) |
|---|---|
| 27 | 22k |
| 35 | 22K |
| 65 | 22K |
| 67 | 10k |
| 69 | 10k |
| 72 | 10K |
| 73 | 100 |
| 75 | 100 |
| 77 | 100 |
| 81 | 100 |
| 82 | 100 |
| 83 | 100 |
| 85 | 100 |
| 87 | 100 |
| 105 | 10 |
| 106 | 10 |
| 107 | 10 |
| 108 | 100 |
| 109 | 0 |
| 110 | 0 |
| 111 | 0 |
| 113 | 10 |
| 115 | 10 |
| 117 | 10 |
| 119 | 10 |

Capacitors

| Element | Value (micro-Farads) |
|---|---|
| 26 | 0.01 |
| 28 | 0.01 |
| 29 | 10 |
| 30 | 10 |
| 63 | 0.01 |

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A device for monitoring the duration of a selected type of speech, comprising:

(a) timing circuitry operative upon activation to generate a timing signal;

(b) control circuitry operative in each of a plurality of modes to monitor said timing signal and to produce one of a plurality of event marker signals, respectively, after a corresponding one of a plurality of selected time intervals;

(c) mode selection circuitry, for a single selection corresponding to a type of speech, said mode selection circuitry in electrical communication with said control circuitry and operative in each of a plurality of states to place said control circuitry in a respective one of said plurality of modes; and (d) means for producing an associated perceptible output in response to each of said event marker signals.

2. A device according to claim 1 wherein said timing circuitry, said mode selection circuitry, and said control circuitry are contained within a common housing.

3. A device according to claim 1 wherein said control circuitry is operative in a first one of said modes to produce a first mode first event marker signal after a corresponding first mode first selected time interval and a first mode second event marker signal after a corresponding first mode second selected time interval, said control circuitry further operative in a second one of said modes to produce a second mode first event marker signal after a corresponding second mode first selected time interval and a second mode second event marker signal after a corresponding second mode second selected time interval.

4. A device according to claim 3 wherein the first selected time interval for each of said modes is of a different duration.

5. A device according to claim 1 wherein said perceptible output is a visual display.

6. A device according to claim 5 wherein said visual display includes a plurality of lights, each of said lights being in electrical communication with a corresponding one of said event marker signals.

7. A device according to claim 6 wherein each of said lights is a unique color.

8. A device according to claim 1 wherein said perceptible output is an audible display.

9. A device according to claim 1 including a numeric display for indicating duration of said timing signal.

10. A device according to claim 1 including a control operative to activate said timing circuitry.

11. A device according to claim 1 wherein said perceptible output is adapted to vary its display in response to a selected one of said event marker signals.

12. A device according to claim 2 wherein said housing is substantially parallelopiped in shape.

13. A device according to claim 2 including a plurality of mode speech type indicia visibly disposed on said housing, each mode speech type indicia identifying a selected one of said modes.

14. A device according to claim 1 wherein said control circuitry is in the form of a programmable integrated circuit chip.

15. A device for monitoring duration of a selected type of speech, comprising:

(a) timing circuitry operative upon activation to generate a timing signal;

(b) control circuitry responsive to the timing signal and operative to produce at least three event marker signals, each after a corresponding one of at least three different sequential respective selected time intervals; and (c) means for producing an associated perceptible output in response to each one of said event marker signals, said perceptible output operative to vary in response to at least one of said event marker signals.

16. A device according to claim 15 including a numeric display for indicating duration of said timing signal.

17. A device according to claim 15 including a control operative to activate said timing circuitry.

18. A device according to claim 15 wherein said timing circuitry and said control circuitry are contained within a common housing that is substantially parallelepiped in shape with one surface configured as an inclined control panel.

19. A device according to claim 18 including speech type indicia visibly disposed on said control panel.

20. A method for monitoring a selected type of speech, comprising the steps of:

(a) selecting at least one of a plurality of modes corresponding to a selected speech type;

(b) generating a timing signal upon initiation of said speech;

(c) monitoring duration of said timing signal;

(d) producing at least three event marker signals, each of said event marker signals occurring upon expiration of a corresponding one of a plurality of respective first, second, and third selected time intervals; and (e) producing an associated perceptible output in response to each of said event marker signals.

21. The method of claim 20 wherein said step of monitoring duration of the timing signal is accomplished by use of a numerical display.

22. The method of claim 20 wherein said step of producing a perceptible output includes activation of a green light in response to a first one of said event marker signals, activation of a yellow light in response to a second one of said event marker signals, and activation of a flashing red light in response to a third one of said event marker signals.

23. The method of claim 22 including a step of producing a fourth event marker signal upon expiration of a corresponding fourth selected time interval, said red light operative to maintain its on condition in response to said forth event marker signal.

24. The method of claim 20 wherein steps (a) through (e) are sequentially repeated for each one of said modes.

* * * * *

UNITED STATES PATENT AND TRADEMARK OFFICE

CERTIFICATE OF CORRECTION

PATENT NO. : 6,326,883 B1
DATED : December 4, 2001
INVENTOR(S) : Whitehead et al.

It is certified that error appears in the above-identified patent and that said Letters Patent is hereby corrected as shown below:

Add to the table starting at column 10, line 44 as the last line data:

| Digit select | Chip 25 pin No. | Numeric display 20 pin No. |
|---|---|---|
| 4 | 33 | 20 |

Signed and Sealed this

Third Day of September, 2002

*Attest:*

*Attesting Officer*

JAMES E. ROGAN
*Director of the United States Patent and Trademark Office*